United States Patent [19]

Craig

[11] Patent Number: 4,712,729

[45] Date of Patent: Dec. 15, 1987

[54] TAMPER EVIDENT ENVELOPE

[75] Inventor: John P. Craig, Redmond, Wash.

[73] Assignee: Trigon Packaging Systems Limited, Hamilton, New Zealand

[21] Appl. No.: 880,882

[22] Filed: Jul. 1, 1986

[51] Int. Cl.[4] ..... B65D 27/08; B65D 27/16

[52] U.S. Cl. ..... 229/72; 206/602; 383/5

[58] Field of Search ..... 229/72, 80, 81; 383/5, 383/38, 85; 206/807, 602

[56] References Cited

U.S. PATENT DOCUMENTS

| | | | |
|---|---|---|---|
| 639,649 | 2/1902 | Johnson | 229/81 |
| 1,195,773 | 8/1916 | Borro | 229/80 |
| 2,154,780 | 4/1939 | Silverberg | 229/80 |
| 2,770,412 | 11/1956 | Ribacoff | 229/80 |
| 3,111,256 | 11/1963 | Hiersteiner | 229/72 |

*Primary Examiner*—Stephen P. Garbe

*Attorney, Agent, or Firm*—Holman & Stern

[57] ABSTRACT

A tamper evident envelope which after closure can be separated into different sections is comprised of front and rear panels joined at their edges except at an opening, a closure flap formed as an extension of the rear panel, a transverse pressure sensitive adhesive closure strip adjacent the opening on the front panel, separators joining the insides of the front and rear panels lengthwise, tear lines along the separators, and adhesive tracks on the flaps and part of the front panel in the regions of the separators which adhere together upon closing the flap.

10 Claims, 3 Drawing Figures

TAMPER EVIDENT ENVELOPE

BACKGROUND OF THE INVENTION

1. Field of the Invention

This invention relates to tamper evident envelopes for the carriage of valuables.

2. Description of the Prior Art

Various forms of tamper evident envelopes are available on the market today which, once sealed, can only be opened in such a manner that is afterwards very apparent upon visual inspection.

Existing envelopes on the market are wasteful when used for smaller articles such as jewelry, cash or the like and there is a need for a tamper evident security envelope which can be used economically and efficiently for smaller articles.

BRIEF SUMMARY OF THE INVENTION

Accordingly it is an object of the present invention to provide a tamper evident envelope which is useable for small articles.

According to the first aspect of the present invention there is provided an envelope comprising a body formed by a front and a rear panel, an opening at at least one edge of the panels, a closure flap as an extension of the rear panel, and a crosswise pressure sensitive adhesive closure strip applied across the full width of the body adjacent the opening. The envelope body is divided into at least two separate compartments by at least one lengthwise separator. Lengthwise pressure sensitive adhesive tracks are provided on either side of each lengthwise separator in the region of the closure flap and the portion of the front panel which it overlaps, and tear lines extend between the adhesive tracks at least throughout the depth of the flap, the arrangement and construction being such that on closure of the flap and the application of pressure to said adhesive strips and tracks the envelope is divided into separate sections and access to the interiors of the separate sections can be gained without disturbing the adjacent closed section.

BRIEF DESCRIPTION OF THE DRAWINGS

The invention will now be described in detail with reference to the accompanying drawings wherein.

DETAILED DESCRIPTION

Figures 1, 2, 3:
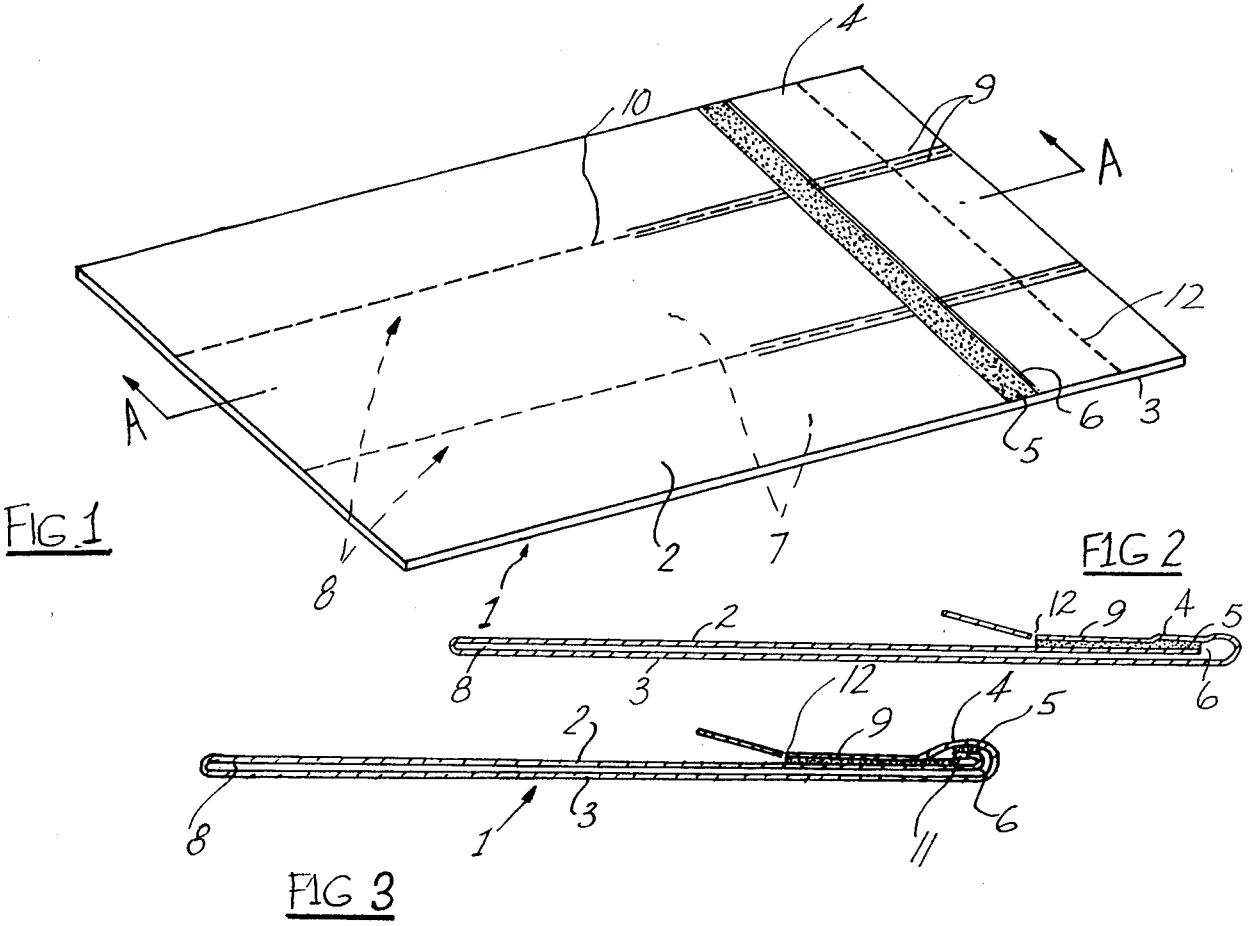
FIG. 1 is a perspective view of the invention in the open position.
FIG. 2 is a cross-sectional view taken along line A—A of FIG. 1, but showing the closed position.
FIG. 3 is a cross-sectional view similar to FIG. 2 showing another embodiment of the invention.

With reference to the drawing, the envelope illustrated comprises a body generally indicated by 1 formed from a front panel 2, a rear panel 3, and a closure flap 4 which is an extension of the rear panel. A crosswise adhesive strip 5 is applied across the full width of the envelope opening 6 on the front panel 2 in the illustrated example. The strip 5 may however be fixed to the closure flap 4. The envelope body is divided into separate compartments 7 by lengthwise separators generally indicated at 8 which are thin strips where the front and rear panels 2 and 3, respectively, are joined together. Each separator 8 is flanked by pressure sensitive adhesive tracks 9 on the outer surface of panel 2. The pressure sensitive adhesive tracks 9 extend at least in the region of the closure flap 4 and the portion of the front panel which it overlaps. Tear lines 10 extend between the adhesive tracks 9 and throughout the length of the envelope through the separators 8.

When the closure flap is sealed (FIG. 2) and pressure is applied to the adhesive strips and tracks 5 and 9, respectively, the envelope is effectively divided into separate compartments. Access to the interiors of one compartment does not disturb the security of the compartment next to it.

The envelope described is designed for a broad range of user. For example a retailer may make use of an envelope as illustrated which has three separate compartments. In the first compartment he may place his daily cash, in the second compartment he may place checks received during the day and in the third compartment he may place credit card receipt forms or the like. This is a convenient way of keeping separate his daily takings which may have different destinations.

Each compartment of the envelope is tamper evident because once sealed the flaps can only be opened separately and in doing so the tear lines 10 in the region of the flap will be broken. As an additional security the pressure sensitive strip 5 may be mounted on an outwardly turned lip 11 of the front panel which extends across the opening 6 thereof, as shown in the embodiment of FIG. 3. Separation of the outwardly turned lip from the adjacent section of the flap will cause the lip 11 to become stretched and wrinkled which would be arrarent on visual inspection of the envelope.

Part of the envelope flap 4 may be used for receipt portions and to facilitate this an additional tear line 12 can be provided where indicated.

In some cases the envelope may be divided into a half dozen or more compartments which are separated from one another by the tear line 10 and in each case the envelope would be tamper evident.

I claim:

1. An envelope comprising:

a body formed from a front and a rear panel having an opening at at least one edge of said panels;

a closure flap formed as an extension of said rear panel and extending beyond said opening;

a crosswise pressure adhesive closure strip applied across the full width of the body adjacent said opening so that when said flap is folded to overlap said front panel and close said opening said closure strip retains said flap in the closed position;

separator means extending lengthwise between said panels to form at least two separate compartments in the envelope;

lengthwise extending pressure sensitive adhesive tracks on said closure flap and on at least the portion of said front panel which said closure flap overlaps on at least one of said separator means; and tear lines extending between said adhesive tracks for a distance at least of the depth of the flap;

the arrangement and construction being such that on closing of said flap and application of pressure to said adhesive strip and tracks the envelope is divisible into separable sections each having a compartment therein and access to said compartments can be gained without disturbing the adjacent closed section.

2. An envelope as claimed in claim 1 wherein:

said tear lines extend throughout the length of said envelope body.

3. An envelope as claimed in claim 2 wherein:

an outwardly turned lip is provided on said front panel adjacent said opening; and said adhesive strip is on the outer surface of said lip.

4. An envelope as claimed in claim 3 and further comprising:

a crosswise tear line on said flap for enabling a portion at the end of said flap to be removed.

5. An envelope as claimed in claim 1 wherein:

an outwardly turned lip is provided on said front panel adjacent said opening; and said adhesive strip is on the outer surface of said lip.

6. An envelope as claimed in claim 1 and further comprising:

a crosswise tear line on said flap for enabling a portion at the end of said flap to be removed.

7. An envelope as claimed in claim 1 wherein:

said adhesive closure strip is on the outer surface of said front panel.

8. An envelope as claimed in claim 7 wherein:

said tear lines extend throughout the length of said envelope body.

9. An envelope as claimed in claim 8 and further comprising:

a crosswise tear line on said flap for enabling a portion at the end of said flap to be removed.

10. An envelope as claimed in claim 1 wherein:

said adhesive closure strip is on said flap.

* * * * *